US007817100B2

(12) United States Patent
Navarro et al.

(10) Patent No.: US 7,817,100 B2
(45) Date of Patent: Oct. 19, 2010

(54) BALLISTIC RESISTANT ANTENNA ASSEMBLY

(75) Inventors: Julio A. Navarro, Kent, WA (US); Richard N. Bostwick, North Bend, WA (US); Andrew G. Laquer, Tustin, CA (US)

(73) Assignee: The Boeing Company, Chicago, IL (US)

( * ) Notice: Subject to any disclaimer, the term of this patent is extended or adjusted under 35 U.S.C. 154(b) by 18 days.

(21) Appl. No.: 11/564,515

(22) Filed: Nov. 29, 2006

(65) Prior Publication Data

US 2008/0122725 A1 May 29, 2008

(51) Int. Cl.
*H01Q 1/42* (2006.01)

(52) U.S. Cl. ..... 343/872; 343/909

(58) Field of Classification Search ..... 343/772, 343/700 MS, 872, 909
See application file for complete search history.

(56) References Cited

U.S. PATENT DOCUMENTS

| | | | | |
|---|---|---|---|---|
| 3,334,349 | A * | 8/1967 | Wheeler | 343/872 |
| 5,140,338 | A * | 8/1992 | Schmier et al. | 343/909 |
| 5,488,380 | A * | 1/1996 | Harvey et al. | 342/368 |
| 6,028,565 | A * | 2/2000 | Mackenzie et al. | 343/872 |
| 6,670,930 | B2 | 12/2003 | Navarro | |
| 6,714,163 | B2 | 3/2004 | Navarro et al. | |
| 6,768,471 | B2 * | 7/2004 | Bostwick et al. | 343/853 |
| 6,894,654 | B2 * | 5/2005 | Lynch | 343/771 |
| 6,919,854 | B2 * | 7/2005 | Milroy et al. | 343/770 |
| 2005/0093765 | A1 * | 5/2005 | Nagel et al. | 343/895 |
| 2007/0279309 | A1 * | 12/2007 | Schultheiss et al. | 343/786 |
| 2008/0136731 | A1 * | 6/2008 | Wu et al. | 343/872 |

OTHER PUBLICATIONS

Webster's II New College Dictionary, p. 112, Copyright 2001, 1999, 1995 by Houghton Mifflin Company, Boston, MA.

National Institute of Justice, Technology Assessment Program, Ballistic Resistant Protective Materials, NIJ Standard 0108.01, Sep. 1995, Washington DC 20531.

* cited by examiner

*Primary Examiner*—Douglas W Owens
*Assistant Examiner*—Dieu Hien T Duong
(74) *Attorney, Agent, or Firm*—McNees Wallace & Nurick LLC

(57) ABSTRACT

A ballistic resistant antenna for use with a ballistic resistant communications system having a first plate fabricated from a ballistic material. The first plate has at least one opening configured to allow transmission of electromagnetic energy at a predetermined range of electromagnetic wavelengths. The antenna also has at least one plug having a geometry that is capable of insertion into the at least one opening. The at least one plug is made up of a material that is substantially transparent to the predetermined range of electromagnetic wavelengths.

17 Claims, 10 Drawing Sheets

BALLISTIC RESISTANT ANTENNA ASSEMBLY

STATEMENT REGARDING FEDERALLY SPONSORED RESEARCH OR DEVELOPMENT

This invention was made with Government support under Contract #JUYS05001 awarded by U.S. Army. The Government has certain rights in this invention.

FIELD OF THE INVENTION

The present disclosure is directed to antenna assemblies. In particular, the present disclosure is directed to antenna assemblies having a ballistic resistant structure.

BACKGROUND OF THE INVENTION

Antennas find use in a variety of applications, including those applications subject to ballistic impact, such as in military vehicles. Such vehicles are typically in harsh, adverse and violent environments where ballistic protection is essential to the vehicle survival. Antennas may emit or receive electromagnetic energy, for example, for the purposes of communication. The current urban environment warfare requires a large amount of close-in combat. Electro-optical/electromagnetic data links, radar and other electromagnetic sensors are sensitive devices critical to the success of a military mission. Communication and sensors may help to extend the life of personnel and increase the effectiveness of a vehicle. However, antennas for use with communication systems for use on such vehicles suffer from the drawback that in order to send and receive the electromagnetic energy from the desired directions, the antennas are typically fabricated from materials and are mounted in locations that are vulnerable to ballistic threats. In order to protect the communications devices from ballistic threats, protective shields may be installed around or near the communication devices. However, protective shields capable of providing protection from ballistic threats are generally not transparent or permeable to the operating electromagnetic frequencies of most antennas. Therefore, currently no antenna system exists that provides antennas capable of emitting and/or receiving electromagnetic energy while remaining resistant to ballistic attack.

Typically, metallic barriers are used to provide some level of protection from ballistic threats, such as fragments, bullets, or projectiles. For example, thick armor plates are typically welded underneath military vehicles to provide protection from mines and other explosives, such as improvised explosive devices (IEDs). However, such metallic barriers retard transmission of electromagnetic energy, making communicating or sensing, either electrically, optically, thermally or with some other electromagnetic phenomena, through this protective barrier difficult or impossible. Therefore, antennas currently available are substantially unprotected from ballistic attack.

What is needed is a system that provides a communication system, including an antenna, with ballistic resistance, while providing substantially unimpeded transmission and/or receiving of electromagnetic energy.

SUMMARY OF THE INVENTION

The present disclosure includes a ballistic resistant antenna for use with a ballistic resistant communications system having a first plate fabricated from a ballistic material. The first plate has at least one opening configured to allow transmission of electromagnetic energy at a predetermined range of electromagnetic wavelengths. The antenna also has at least one plug having a geometry that is capable of insertion into the at least one opening. The at least one plug is made up of a material that is substantially transparent to the predetermined range of electromagnetic wavelengths.

Another aspect of the disclosure includes a ballistic resistant antenna for a communication system having a first plate fabricated from a ballistic material. The first plate has at least one opening configured to allow transmission of electromagnetic energy at a predetermined range of electromagnetic wavelengths. The antenna also has at least one plug having a geometry that is capable of insertion into the at least one opening. The at least one plug is made up of a material that is substantially transparent to the predetermined range of electromagnetic wavelengths. The antenna further having an electromagnetic energy device mounted adjacent to a second plate, the second plate being adjacent to the first plate. The electromagnetic energy device is a device arranged and disposed to emit and/or receive electromagnetic energy via the opening.

Another aspect of the disclosure includes a method for making an antenna for a ballistic resistant communications device. The method includes providing a first plate fabricated from a ballistic material. At least one opening is formed into the first plate. The opening is configured to allow transmission of electromagnetic energy at a predetermined range of electromagnetic wavelengths. A plug is provided having a geometry configured to mate a surface of the opening. The plug is inserted into the opening. A source of electromagnetic energy is provided and configured to emit, receive or emit and receive predetermined wavelengths of electromagnetic energy.

An advantage of the present disclosure is that the antenna according to the present disclosure is capable of withstanding a Department of Justice Level IV ballistic threat, while maintaining communication via transmission of electromagnetic energy.

Another advantage of the present disclosure is that vehicles equipped with ballistic resistant communication systems according to an embodiment of the present disclosure allow continuous communication, while vehicles are operating in hostile environments subject to ballistic threats. Further, the ability of the communication and/or radar system to absorb heavy fire from close-in threats while maintaining electronic communication and radar functions increases the likelihood that the threat can be identified and/or eliminated.

Still another advantage of an embodiment of the present disclosure includes the ability to utilize sensors that allow a vehicle to electro-magnetically sense the current terrain, road conditions or other conditions present underneath the vehicle.

Other features and advantages of the present disclosure will be apparent from the following more detailed description of the preferred embodiment, taken in conjunction with the accompanying drawings which illustrate, by way of example, the principles of the disclosure.

BRIEF DESCRIPTION OF THE DRAWINGS

Wherever possible, the same reference numbers will be used throughout the drawings to refer to the same or like parts.

DETAILED DESCRIPTION OF THE INVENTION

The present disclosure is directed to a ballistic resistant communication system having an antenna utilizing ballistic resistant material. Communication system, as used herein include systems that utilize electromagnetic energy either emitted or received to communicate or sense conditions. Examples of communications systems include, but are not limited to radar systems, broadband communications systems, and radio frequency (RF) sensor systems. The wavelengths of electromagnetic energy usable with the present disclosure are not particularly limited and may include any wavelength usable as a communication, sensing or radar application. Suitable wavelengths for use with the present disclosure may include, but is not limited to super high frequency (i.e., 3-30 GHz), $K_u$ band, (i.e., 12-18 GHz), or any other frequency, such as Q-band, K-band, $K_A$-band, and X-band, usable for communications or sensing applications.

Ballistic resistant material and material resistant to ballistic threat, as utilized herein, means a material that provides protection against projectiles, or gunfire, preferably a material that may be classified as a ballistic resistance equal to or greater than a Type 1 ballistic resistant protective material, as defined in National Institute of Justice "Ballistic Resistant Protective Materials", NIJ Standard 0108.01, September 1985. In a preferred embodiment of the disclosure the ballistic resistant material utilized in the article of the present disclosure is at least a Type IV Ballistic Resistance, as defined in NIJ Standard No. 0108.01, specifically resistant to at least one 30 caliber armor piercing round of a 10.8 gram bullet shot at a velocity of at least 838 meters/second +/−15 meters per second. Ballistic resistance of a material is dependent upon a combination, among other things, of the materials used, the material's structure and the overall thickness of the material. Ballistic threat, as utilized herein, means a projectile, such as a bullet, missile, shrapnel or other object, that is accelerated with sufficient velocity to damage and/or penetrate a material upon impact.

Figure 1:
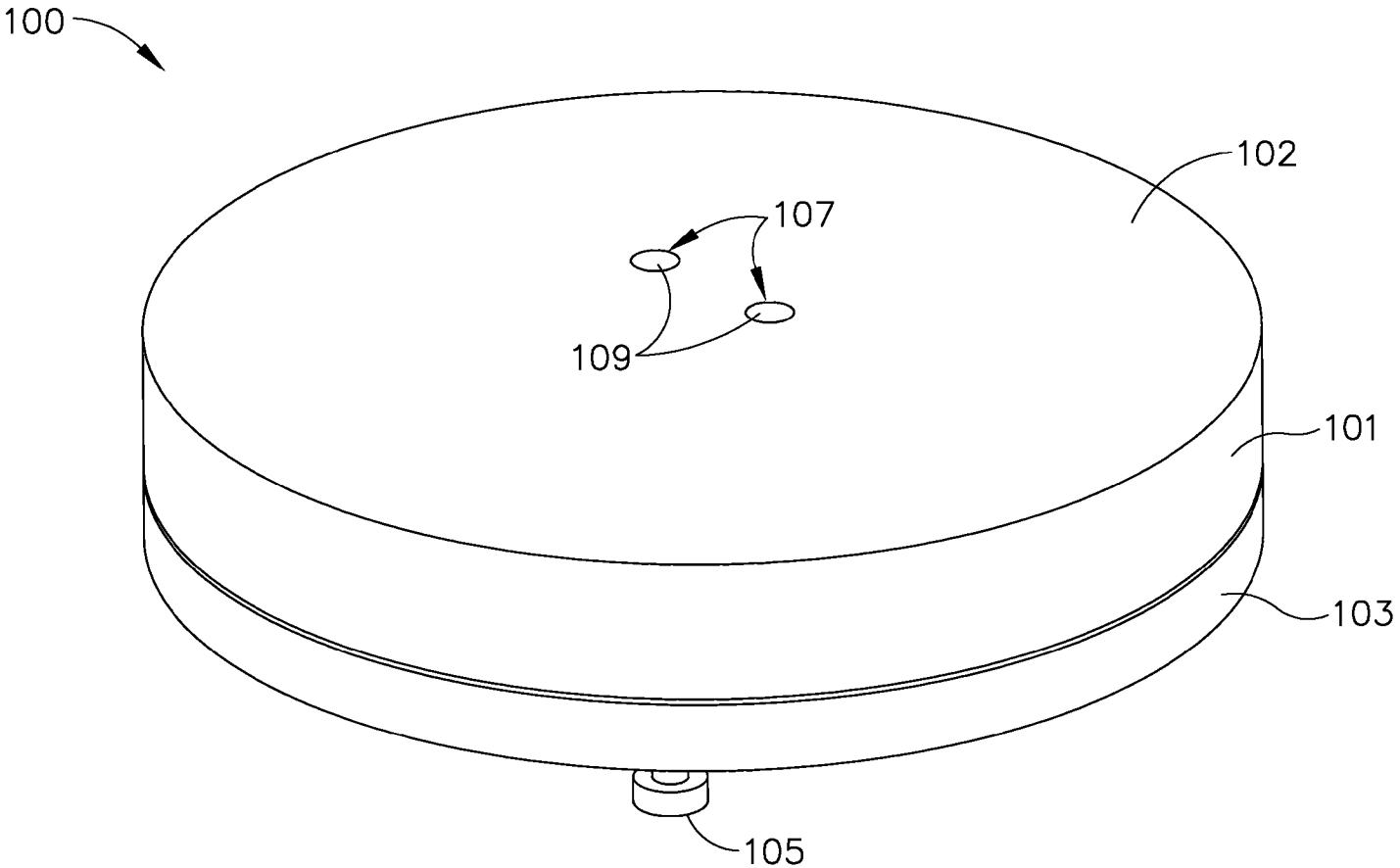
FIG. 1 shows a perspective view of an antenna according to an embodiment of the present disclosure.

FIG. 1 illustrates a ballistic resistant antenna 100 for use with a sensor or communication system. The antenna 100 includes a front, or first plate 101 fabricated from a ballistic resistant material. This first plate 101 preferably functions as the antenna's active aperture plate and also provides the front plate structure of the antenna. In addition, the first plate 101 is preferably arranged and disposed to provide protection for underlying electronic equipment. Suitable ballistic materials include metals, alloys, ceramics, fabrics, fiber or fabric reinforced polymers, or any combination thereof. For example, a suitable ballistic material includes a steel conforming to the Military Specification, MIL-A-46100D, October 1986. Suitable materials for use as the first plate 101, including the surfaces of the waveguide openings 107 preferably include a conductive surface, wherein non-conductive materials may be utilized by coating the non-conductive material with a conductive plating. In addition, conductive surfaces may likewise be coated with a conductive material. The thickness of the first plate 101 may be any thickness that provides ballistic resistance for particular material making up the first plate 101. More specifically, the first plate 101 has sufficient thickness to provide ballistic resistance, while permitting operation of the antenna. Surface 102 of the first plate 101 is preferably smooth in order to provide a front plate structure for the antenna in order to increase the antenna's ability to emit and receive electromagnetic energy. In one embodiment of the present disclosure, the surface of the first plate 101 are ground to a surface finish preferably a minimum of about 32 root-mean-square (RMS) measured in microinches. Measurement of the surface finish may be accomplished with any mechanical, electrical or optical measurement technique known in the art. Preferably the surface of opening 107 has a finish from about 16 RMS and about 32 RMS. First plate 101 is attached to a base, or second plate 103, which is configured to house electromagnetic energy sources and/or receivers. The electromagnetic sources and/or receivers are not particularly limited and may include any devices capable of emitting and/or receiving electromagnetic energy, particularly for the purposes of communications or sensing. Antenna 100 includes a mounting fastener 105 to attach the antenna 100 to a vehicle or other structure.

The first plate 101 further comprises opening 107 configured to receive waveguide plugs 109. The wave guide plugs 109 are fabricated from a material that is configured to allow the passage of electromagnetic energy. The waveguide openings 107 and the corresponding surface of waveguide plugs 109 are preferably tapered to provide addition impact resistance in the event of a ballistic impact. The waveguide openings 107 may be formed using any suitable technique. For example, the waveguide openings 107 may be machined through the first plate 101.

In one embodiment of the disclosure, a pilot hole is bored through the first plate 101 and a tapered waveguide opening 107 is formed via wire electrical discharge machining (wire EDM). The surface of the waveguide opening 107 is preferably sufficiently smooth to reduce the amount of electromagnetic energy lost via mechanisms such as absorption or reflection into first plate 101. The inside waveguide surface is preferably smooth and highly electrically conductive, wherein the smooth, conductive surface may be provided by plating a conductive material thereon. For example, a plating of gold or other conductive material may be provided to the surface of opening 107 and/or the surface of first plate 101 to provide a surface having desirable surface properties. The waveguide plug 109 is preferably fabricated from a ballistic resistant material that is substantially transparent to electromagnetic energy. By substantially transparent to electromagnetic energy, it is meant that electromagnetic energy may pass through the material without significant absorption, or reflection of the energy, and sufficient passage of electromagnetic energy occurs to permit the communication or sensing desired. Suitable material for use at the waveguide plugs 109 includes ballistic resistant material having a low dielectric constant and a low dielectric loss at the frequencies emitted or received by the electromagnetic energy source and/or receiver. Examples of materials having a low dielectric constant and a low dielectric loss at desirable ranges of electromagnetic frequency ranges include, but are not limited to, ceramics such as silicon nitride, glass, quartz, and alumina. The waveguide plugs 109 may be fabricated by any suitable technique including, but not limited to, powder metallurgical formation (e.g., via pressing and sintering) with subsequent finishing steps (e.g., via grinding and/or polishing). The waveguide plug 109 is preferably fabricated by utilizing a grinding process on an outer diameter grinder.

Figure 2:
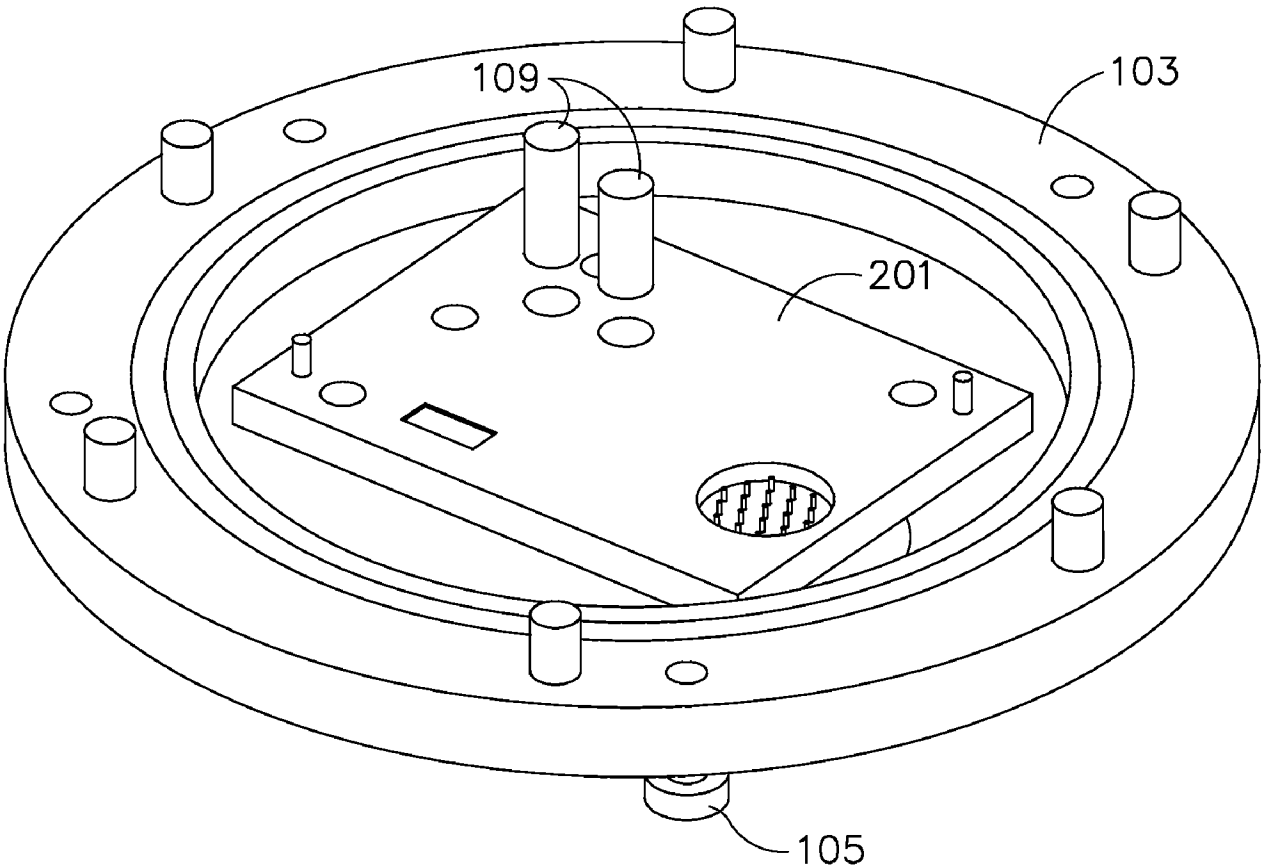
FIG. 2 shows a perspective view of an antenna according to an embodiment of the present disclosure, wherein the front plate is removed.

FIG. 2 shows antenna 100 with the first plate 101 removed. FIG. 2 shows the electromagnetic energy device 201 attached to second plate 103. The electromagnetic energy device 201 is configured to emit or receive electromagnetic energy over a range of wavelengths in a direction through waveguide plugs 109. The device 201 is preferably a circuit board or set of electronic circuitry configured to emit and/or receive electromagnetic energy. Waveguide plugs 109 are shown in relation to the electromagnetic energy device 201 and are preferably inserted into openings 107 of first plate 101, as shown in FIG. 1. The operation and configuration of the electromagnetic energy device 201 may take place using known operational and configuration techniques usable with electromagnetic devices 201.

Figure 3:
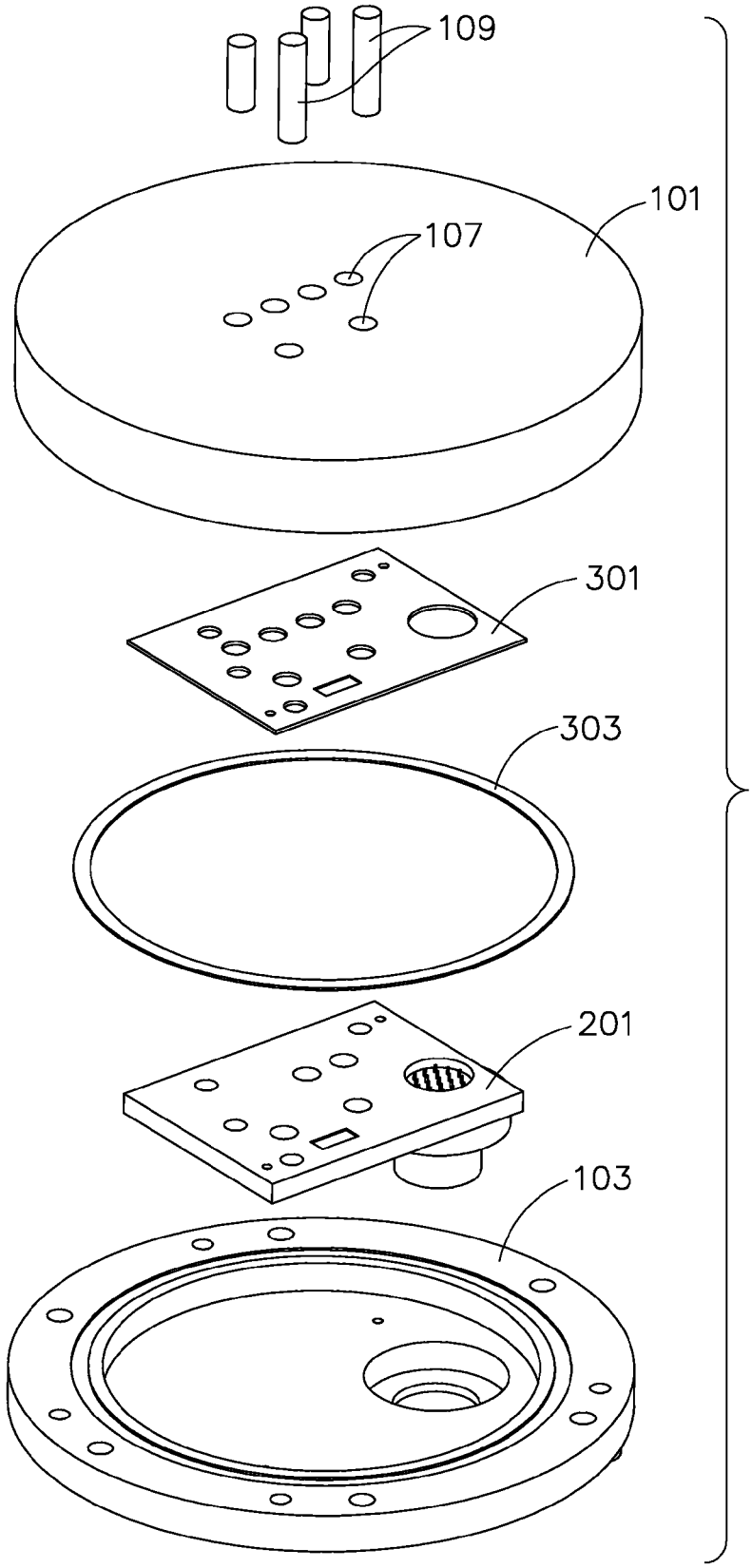
FIG. 3 shows an exploded perspective view of an antenna according to an embodiment of the present disclosure.

FIG. 3 shows an exploded view of the components of antenna 100 according to the present disclosure wherein electromagnetic energy source 201 is attached to second plate 103, wherein a ground contact shim 301 and an o-ring 303 are disposed between the first plate 101 and second plate 103. While not required, the ground contact shim 301 provides electrical contact with first plate 101 in order to provide a ground, which in combination with the electromagnetic energy source 201 facilitates efficient operation of the antenna. Also, while not required, o-ring 303 seals the electromagnetic energy device 201 into the antenna 100, protecting the electronics from external atmospheres. Further, the seal provided by o-ring 303 preferably provides a fluid-tight seal preventing infiltration of moisture and/or corrosive compounds. First plate 101 is attached to second plate 103 by any suitable attachment method, including, but not limited to, bolting, brazing, welding or adhering the first plate 101 to the second plate 103. Waveguide plugs 109 are inserted into waveguide openings 107. The first plate 101 and the waveguide plugs 109 may be covered with a wide angle impedance matching (WAIM) coating, paint and/or appliqué 701,703 (see e.g., FIG. 7).

Figure 4:
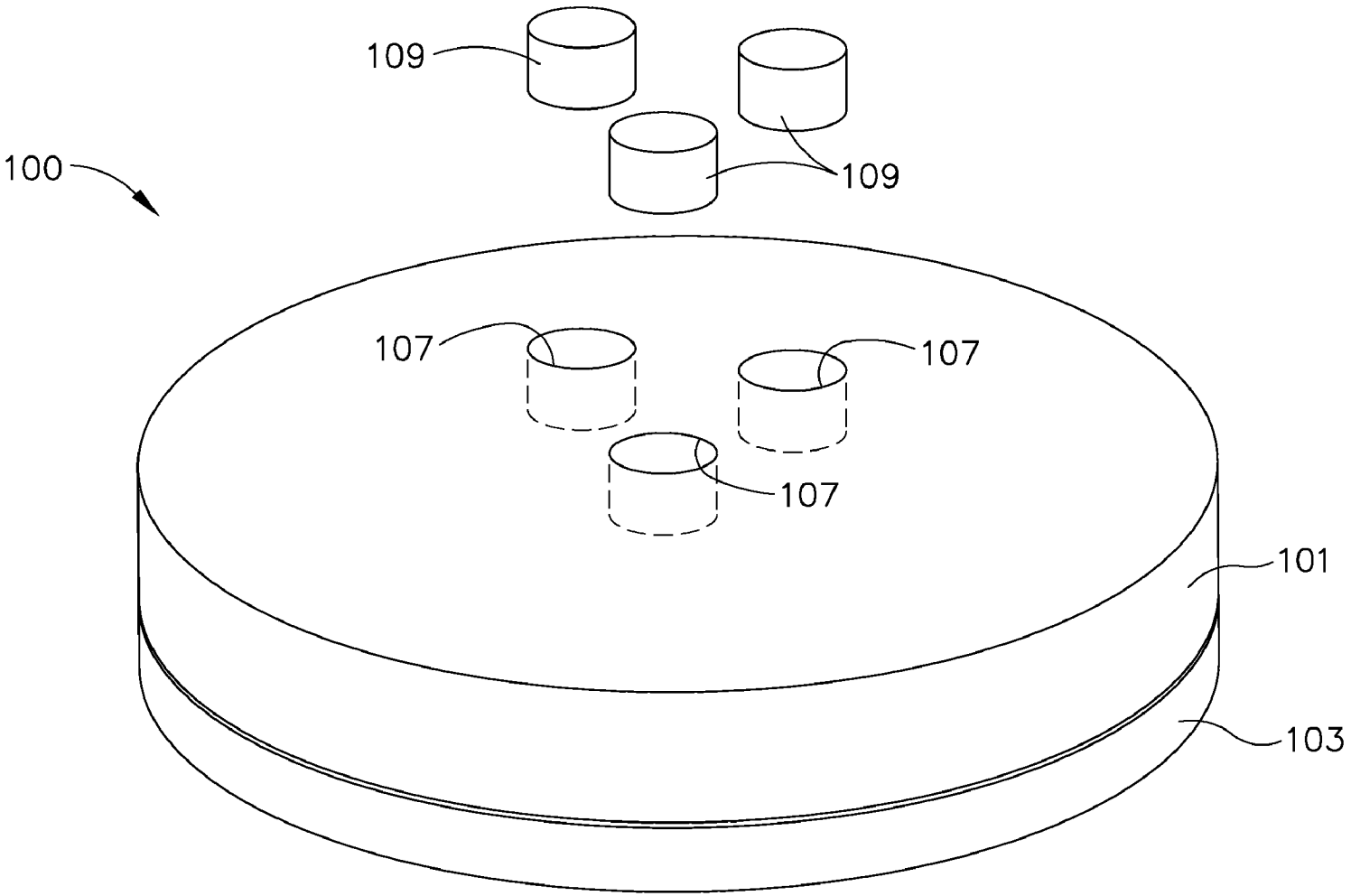
FIG. 4 shows a schematic view of an antenna according to an embodiment of the present disclosure.

FIG. 4 shows an antenna 100 according to an embodiment of the present disclosure wherein waveguide plugs 109 have a substantially cylindrical geometry. The preferred diameter of the waveguide plug 109 and opening 107 is dependent on frequency and the dielectric constant of the dielectric plug and may be varied based upon the desired frequency for the antenna and the particular material utilized for the waveguide plug 109. The waveguide plugs 109 are preferably tapered from a larger diameter farthest away from the second plate 103 to a smaller diameter nearer to second plate 103 and being substantially adjacent second plate 103, when installed. In one embodiment of the present disclosure, the waveguide plug 109 is provided with a 0.50 degree taper. The taper is configured so that upon impact, the load resulting from the projectile impact can be transmitted to the first plate 101. The corresponding waveguide openings 107 preferably have a mating, tapered surface. The tapered surfaces engage to provide additional ballistic resistance and to distribute forces resulting from a ballistic impact to first plate 101 in a manner that protects the electronics of electromagnetic energy device 201. In other words, the taper is sufficient to resist plugs 109 from being propelled through openings 107 and into device 201 by ballistic impact with plugs 109 and/or first plate 101.

Figure 5:
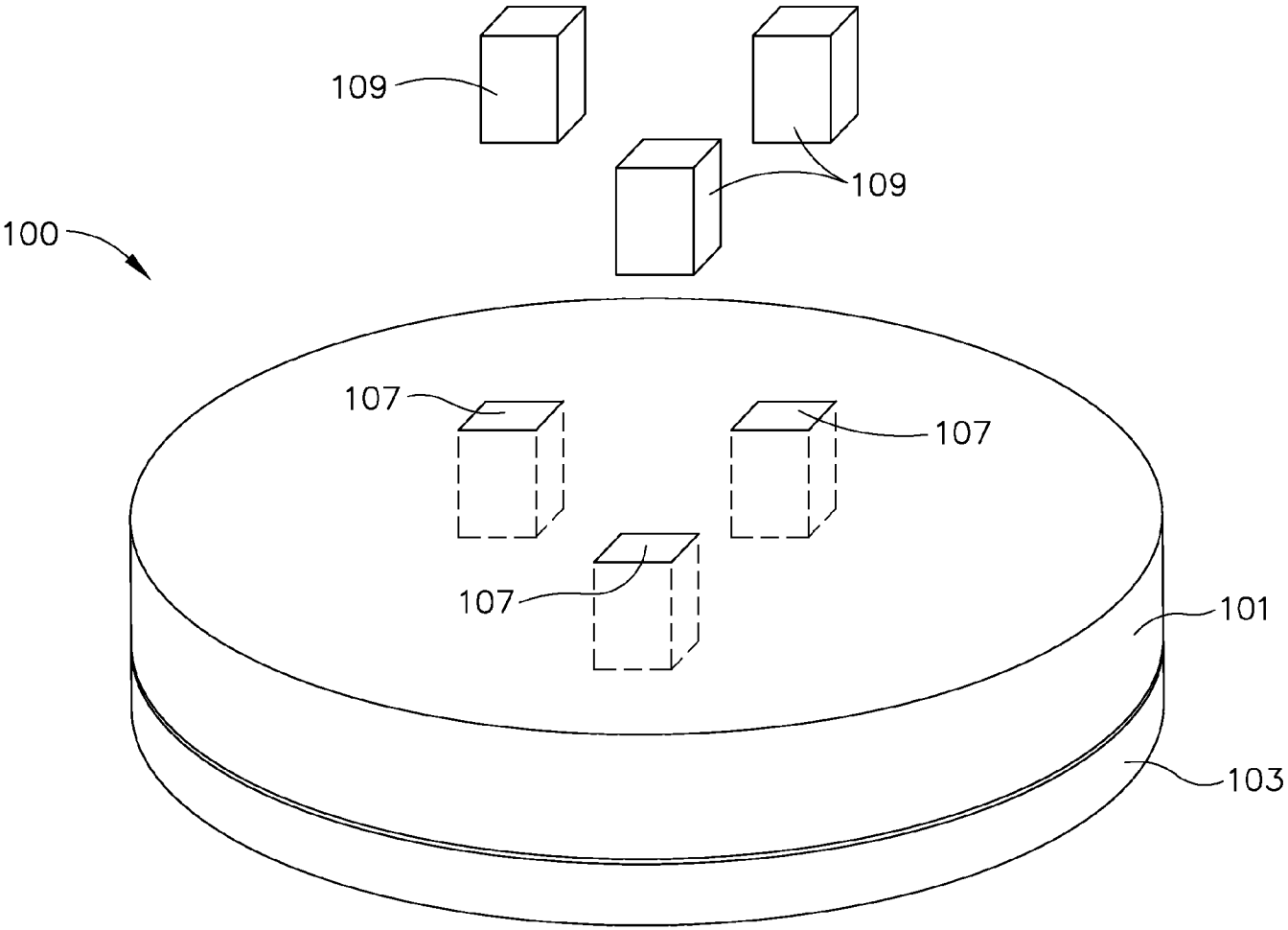
FIG. 5 shows a schematic view of an antenna according to another embodiment of the present disclosure.

FIG. 5 shows an antenna 100 according to another embodiment of the present disclosure wherein waveguide plugs 109 have a substantially square cross-sectional geometry. As discussed above with respect to FIG. 4, the plugs are preferably tapered from a larger cross-sectional farthest away from second plate 103, to a smaller cross-section nearer the second plate 103. Likewise the embodiment shown in FIG. 5 preferably includes waveguide opening 107 that mate or conformally receive waveguide plugs 109.

Figure 6:
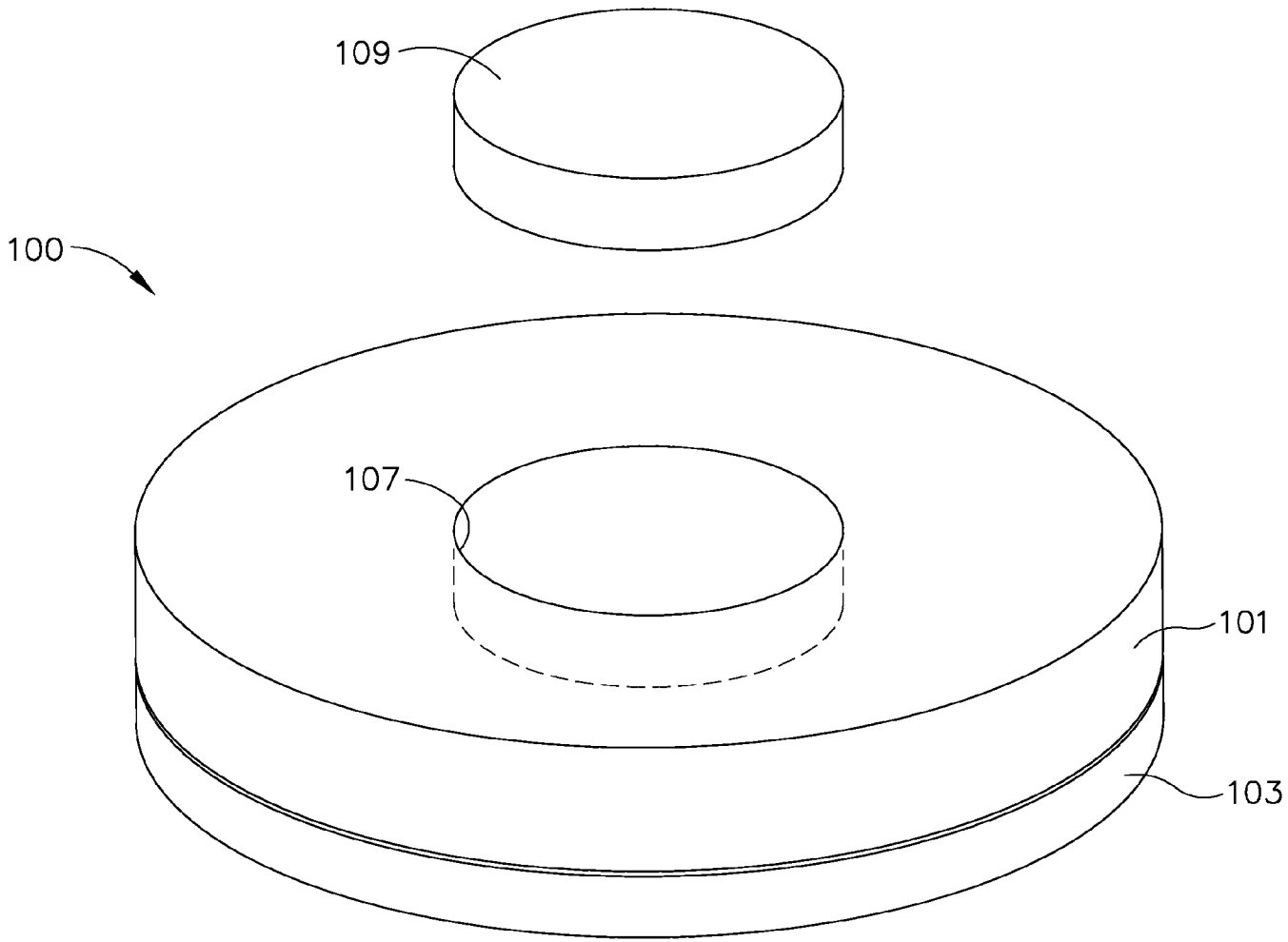
FIG. 6 shows a schematic view of an antenna according to still another embodiment of the present disclosure.

FIG. 6 shows an antenna 100 according to still another embodiment of the present disclosure wherein a single, large waveguide plug 109 is provided. As shown and described with respect to FIG. 4, the waveguide plug 109 and waveguide openings 107 preferably have tapered, mating surfaces. The large waveguide plug 109 is easier to fabricate and provides a single, contiguous enlarged area in which transmission of electromagnetic energy may occur. Further, this embodiment of the disclosure has the advantage that less components need to be fabricated and/or machined. Optionally waveguide plug 109 and opening 107 may include a notch or clocking feature to ensure proper installation/orientation of waveguide plug 109 with respect to device 201.

Figure 7:
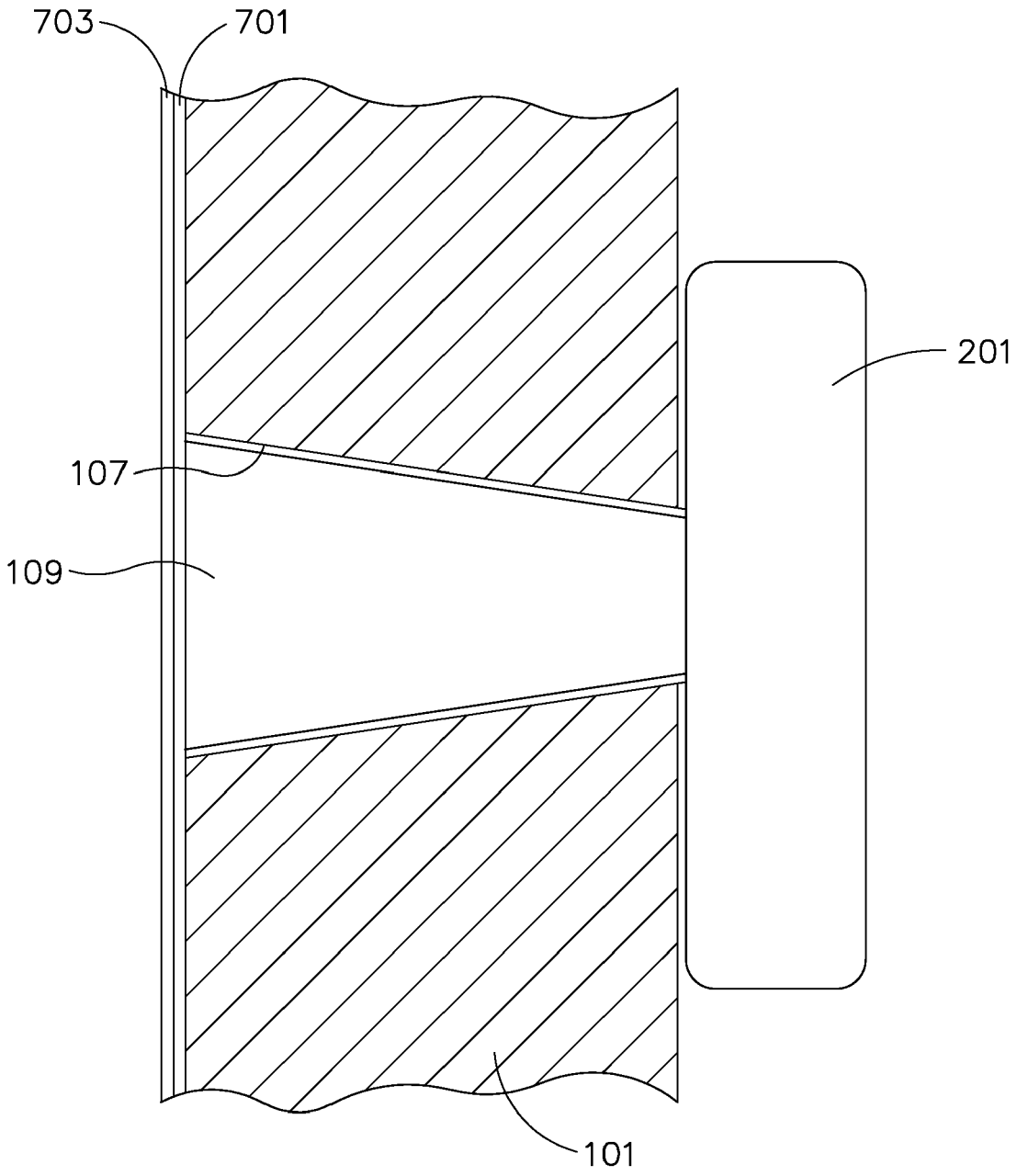
FIG. 7 shows an enlarged cutaway view of a section of an antenna according to the present disclosure.

FIG. 7 shows an enlarged section of an antenna according to an embodiment of the present disclosure including first plate 101 having a waveguide plug 109 installed. As shown in FIG. 7, the waveguide plug 109 has a tapered geometry with increasing radius from electromagnetic energy device 201. In addition, the surface of waveguide plug 109 engages a surface of waveguide opening 107. The amount of taper is preferably a sufficiently large taper to distribute energy from a ballistic impact, but of sufficient opening to allow emission and/or receiving of electromagnetic energy sufficient to provide communications and/or sensing ability. The waveguide plug 109 is coated with an environmental coating 701 to seal, retain and/or protect the waveguide plugs 109 and first plate 101, including but not limited to wide angle impedance matching (WAIM) coating, resin impregnated quartz cloth or any other environmentally protective coating suitable for providing environmental protection and capable of retaining the waveguide plug 109 in position in opening 107. WAIM coatings are well-known in the art of phased-array antennas to include layers of adhesives, preferably epoxy-based adhesives, with an interdisposed foam layer and epoxy e-glass top sheet configured to provide the antenna 100 with the desired antenna functionality. The waveguide plug 109 further includes a top coat 703, including but not limited to a paint or appliqué. The environmental coating 701 and/or top coat 703 also retain the waveguide plug 109 in position. Like the waveguide plug 109, the environmental coating 701 and top coat 703 are preferably substantially transparent to electromagnetic energy at the desired range of wavelengths. While FIG. 7 shows the presence of an environmental coating 701 and a top coat 703, one or both may be omitted. While the waveguide plug 109 is preferably inserted into waveguide opening 107 and held in place by the environmental coating 701 and/or the top coating 701, the waveguide plug 109 may be adhered to the waveguide opening 107 by use of surface features on the waveguide plug 109 and the mating waveguide opening 107, by adhesive, or by any other suitable attachment method.

The present disclosure is not limited to the configurations of waveguide plugs 109 shown and described above. The waveguide plugs 109 and their mating waveguide openings 107 may have any geometry that permits the passage of electromagnetic energy from the electromagnetic energy device 201. The waveguide plugs 109 may include combinations of geometries, such as square and circular cross-sectional geometries. Further, the waveguide plugs 109 may include a plurality of different sizes. Further, while the above embodiments refer to waveguide plugs 109 inserted into first plate 101, the present disclosure is not limited to this embodiment and may include a first plate 101 fabricated from a material that is substantially transparent to electromagnetic energy, is ballistic resistance and can form the operational structure of the antenna 100 in combination with electromagnetic energy device 201.

The combination of ballistic resistant material of the first plate 101 and ballistic resistance and low dielectric waveguide material of the waveguide plugs 109 allows a vehicle equipped with a communications system utilizing an antenna 100 according to the present disclosure to maintain communications, such as broadband communication, or use radar sensors even in hostile environments. The antenna's ability to absorb heavy fire from close-in threats while maintaining electronic communication and radar functions makes it more likely that the threat can be identified and/or eliminated. The use of antennas 100 according to the present disclosure is useful for various applications in hostile environments.

Figure 8:
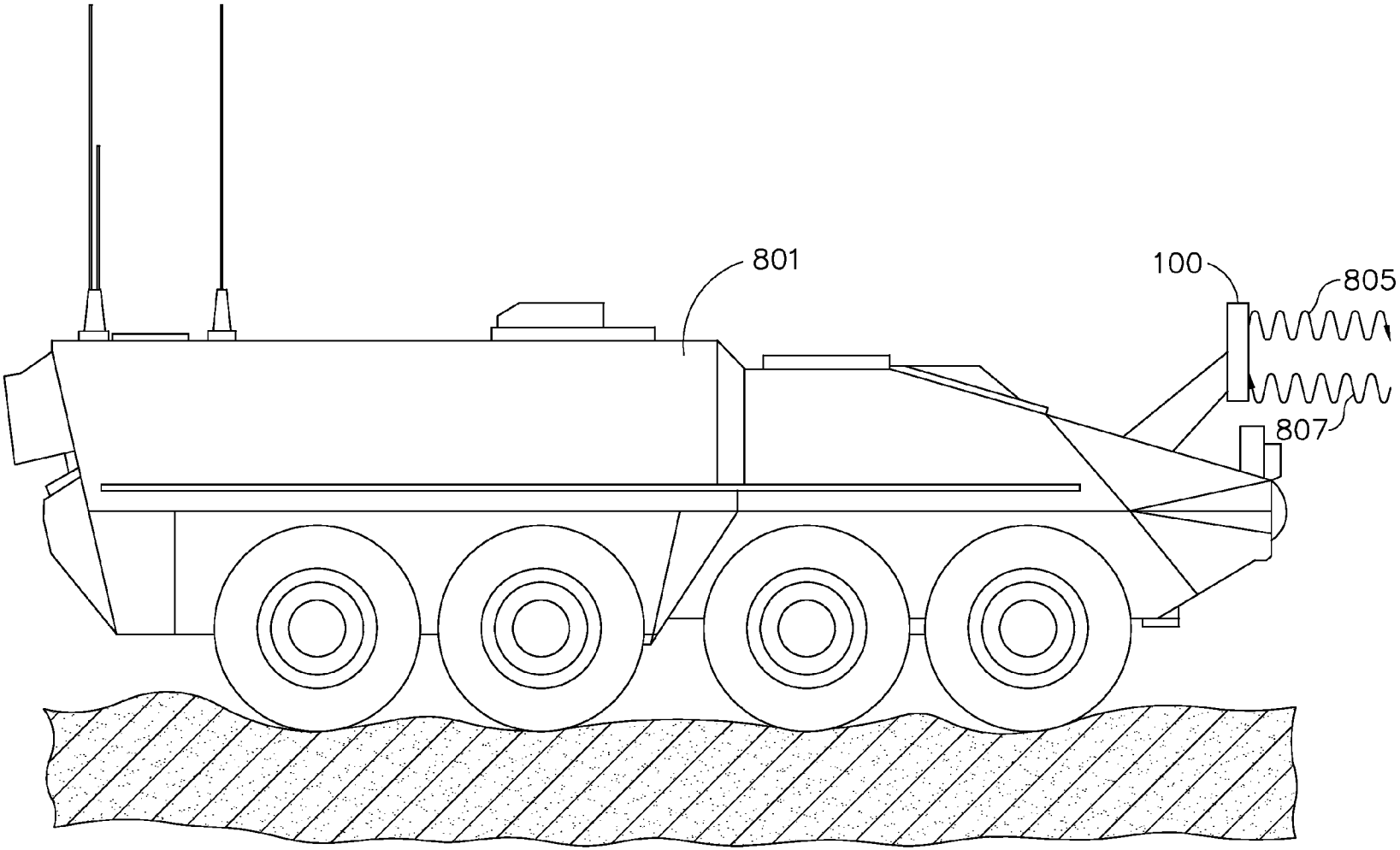
FIG. 8 shows a schematic view of a vehicle system according to an embodiment of the present disclosure.

FIG. 8 shows a vehicle 801 having an antenna 100 for communicating or sensing. The vehicle 801 preferably includes a communication system utilizing the antenna 100 to emit (i.e., emitted electromagnetic energy 805) or receive (i.e. received electromagnetic energy 807). The antenna includes ballistic resistant material to protect electromagnetic energy device 201 and to maintain communication or sensing abilities during operation. The antenna 100 permits use of electromagnetic energy for applications such as radar and/or broadband communications, which allow the vehicle 801 to communicate and/or sense threats, permitting the identification and potential elimination of threats.

Figure 9:
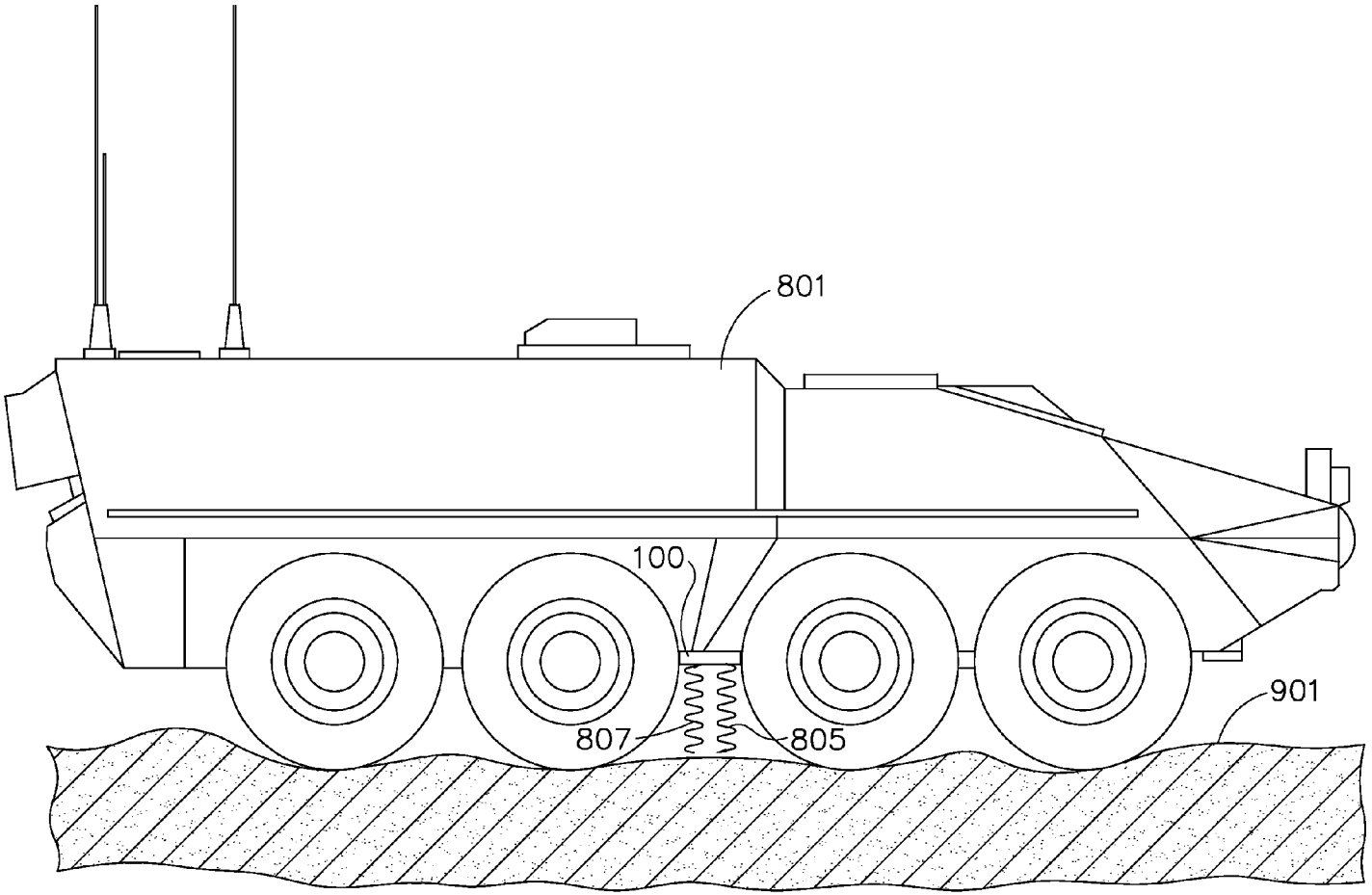
FIG. 9 shows a schematic view of a vehicle system according to another embodiment of the present disclosure.

FIG. 9 shows a vehicle 801 having an antenna 100 according to an embodiment of the disclosure, wherein the antenna 100 is mounted on the underside of the vehicle 801 in locations wherein armor plating typically is utilized. The mounting of the ballistic resistant antenna 100 according to the present disclosure permits the use of the emitted electromagnetic energy 805 and/or received electromagnetic energy 807 to sense terrain 901 or threats, such as mines or IEDs. The ability to electromagnetically sense in locations below the vehicle 801 provides increased life for the vehicle 801 and vehicle 801 personnel. In addition, the sensing of terrain 901 permits the vehicle 801 to operate in a manner that avoids terrain 901 that is detrimental to the operational life of the vehicle 801. For example, highly hostile environments, such as high-pressure or high temperature or extreme corrosive environments, may require protections that do not permit viewing or conventional sensing outside the vehicle. The ballistic resistant communication system of the present disclosure permits sensing and/or communication outside the vehicle while retaining maximum protection within the vehicle. As shown in FIG. 9, ballistic resistant communication devices according to the present disclosure may be incorporated into the armor plates attached to the underside of military vehicles to provide protection from mines, IEDs and other explosive devices, while providing sensor suitable for sensing the current terrain 901 underneath the vehicle 801. In addition, antennas 100 according to the present disclosure could be integrated throughout the vehicle 801 for multiple purposes. For example, may alert vehicle passengers and/or controllers to threats within the surrounding environment. Specifically, the antennas and/or sensors may be arranged on the vehicle or structure to provide one or more of the following: communications, radio frequency (FR) radar, RF identification, optical, chemical and/or biological sensors, laser detection and radar (LADAR), and/or thermal sensors. These functionalities may be provided using sensors having the arrangement of antenna 100 above, wherein the sensors may include a protective armor first plate 101, and a protective dielectric window of a dimension to accommodate and permit operation of the sensor.

Figure 10:
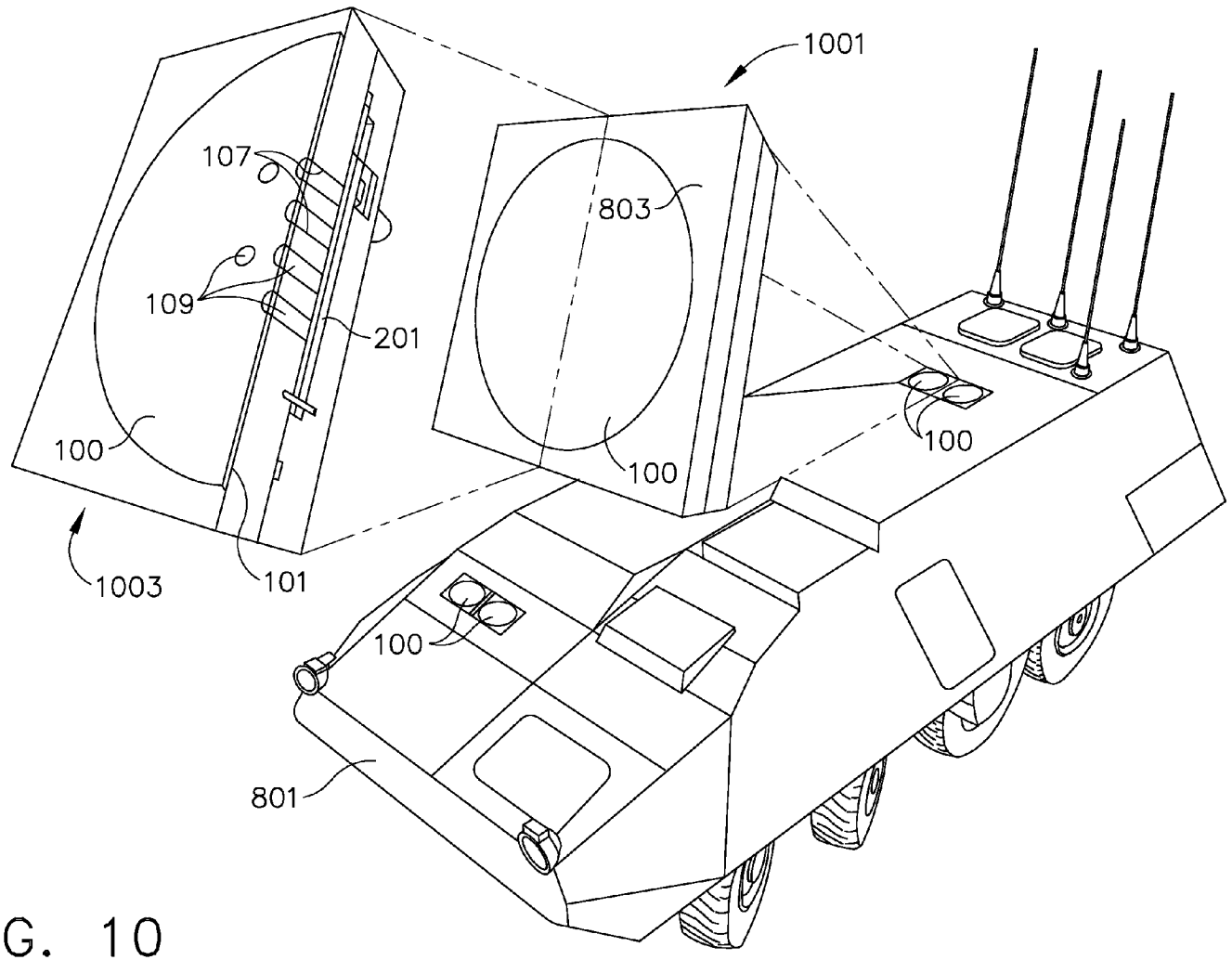
FIG. 10 shows a perspective view with an exploded perspective view and an exploded cross-sectional view of a antenna and vehicle system according to another embodiment of the disclosure.

FIG. 10 shows a perspective view of vehicle 801 having a plurality of antennas 100 according to another embodiment of the disclosure, wherein the antennas 100 are mounted on several locations on the vehicle 801. FIG. 10 further includes an exploded perspective view 1001 illustrating the antenna 100 incorporated into the armor 803 of vehicle 801. In addition, FIG. 10 includes a cutaway perspective view of exploded perspective view 1001 with the waveguide plugs 109 exposed. The waveguide plugs 109 are disposed within waveguide openings 107. In addition, electromagnetic devices 201 is disposed adjacent to the waveguide plugs 109 and are configured to emit and/or receive electromagnetic energy. The mounting of the ballistic resistant antenna 100 according to this embodiment of the present disclosure permits the use of the electromagnetic energy to communicate with and/or sense objects outside vehicle 801 in a variety of directions. As in the above embodiment, highly hostile environments, such as high-pressure or high temperature or extreme corrosive environments, may require protections that do not permit viewing or conventional sensing outside the vehicle. The ballistic resistant communication system of the present disclosure permits sensing and/or communication outside the vehicle while retaining maximum protection within the vehicle. As shown in FIG. 10, ballistic resistant communication devices according to the present disclosure may be incorporated into the armor plates attached to any of the surfaces of vehicles 801 to provide protection from projectiles from substantially all directions.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A ballistic resistant phased array antenna comprising:

a first plate fabricated from a ballistic material, the first plate having at least one opening configured to allow transmission of electromagnetic energy at a predetermined range of electromagnetic wavelengths; and at least one ballistic resistant ceramic plug having a geometry that is capable of insertion into the at least one opening, the at least one ballistic resistant ceramic plug comprising a material that is substantially transparent to the predetermined range of electromagnetic wavelengths;

wherein the ballistic material forming the first plate has a ballistic resistance equal to or greater than a Type 1 ballistic resistant protective material;

wherein the at least one ballistic resistant ceramic plug has a tapered geometry.

2. The antenna of claim 1, wherein the ballistic resistant ceramic plug material is a material substantially transparent to the predetermined range of electromagnetic wavelengths.

3. The antenna of claim 1, wherein the tapered geometry includes a unidirectionally decreasing cross-sectional area of the at least one ballistic resistant ceramic plug.

4. The antenna of claim 3, wherein the tapered geometry provides force distribution between the at least one ballistic resistant ceramic plug and first plate.

5. The antenna of claim 1, wherein the ballistic material forming the first plate comprises steel.

6. The antenna of claim 1, wherein said first plate is painted.

7. The antenna of claim 1, wherein an appliqué is disposed on the first plate.

8. A ballistic resistant phased array antenna for a communication system comprising:

a first plate fabricated from a ballistic material, the first plate having at least one opening configured to allow transmission of electromagnetic energy at a predetermined range of electromagnetic wavelengths;

a ballistic resistant ceramic plug having a geometry that is capable of insertion into the at least one opening, the ballistic resistant ceramic plug comprising a material that is substantially transparent to the predetermined range of electromagnetic wavelengths; and an electromagnetic energy device mounted adjacent to a second plate, the second plate being adjacent to the first plate;

wherein the ballistic material forming the first plate has a ballistic resistance equal to or greater than a Type 1 ballistic resistant protective material;

wherein the ballistic resistant ceramic plug has a tapered geometry.

9. The antenna of claim 8, wherein the ballistic resistant ceramic plug comprises a ceramic material.

10. The antenna of claim 8, wherein the tapered geometry includes a unidirectionally decreasing cross-sectional area of the ballistic resistant ceramic plug.

11. The antenna of claim 10, wherein the tapered geometry provides force distribution between the ballistic resistant ceramic plug and first plate.

12. The antenna of claim 8, wherein the electromagnetic energy device is configured to emit, receive or emit and receive electromagnetic energy through the opening.

13. The antenna of claim 8, wherein the ballistic material forming the first plate is a steel.

14. The antenna of claim 8, wherein said first plate is painted.

15. The antenna of claim 8, wherein an appliqué is disposed on the first plate.

16. A method for making a phased array antenna for a ballistic resistant communications device comprising:

providing a first plate fabricated from a ballistic material, forming at least one opening into the first plate, the at least one opening configured to allow transmission of electromagnetic energy at a predetermined range of electromagnetic wavelengths; and providing at least one ballistic resistant ceramic plug having a geometry configured to be conformally received in the opening;

inserting the at least one ballistic resistant ceramic plug into the at least one opening; and configuring a source of electromagnetic energy to emit, receive or emit and receive predetermined wavelengths of electromagnetic energy;

wherein the ballistic material forming the first plate has a ballistic resistance equal to or greater than a Type 1 ballistic resistant protective material;

wherein opening and the at least one ballistic resistant ceramic plug are formed having tapered surfaces.

17. The method of claim 16, wherein the forming step includes wire electrical discharge machining.

* * * * *